US009074357B2

(12) United States Patent
Meehan et al.

(10) Patent No.: US 9,074,357 B2
(45) Date of Patent: Jul. 7, 2015

(54) MOUNTING BRACKET FOR ELECTRONIC KITCHEN FAUCET

(75) Inventors: Steven Kyle Meehan, Fishers, IN (US); Zhichuang Huang, Guangzhou (CN); Jia Lin, Guangzhou (CN)

(73) Assignee: Delta Faucet Company, Indianapolis, IN (US)

( * ) Notice: Subject to any disclaimer, the term of this patent is extended or adjusted under 35 U.S.C. 154(b) by 1108 days.

(21) Appl. No.: 13/093,552

(22) Filed: Apr. 25, 2011

(65) Prior Publication Data

US 2012/0267493 A1 Oct. 25, 2012

(51) Int. Cl.

| | |
|---|---|
| ***E03C 1/042*** | (2006.01) |
| ***E03C 1/05*** | (2006.01) |
| ***E03C 1/04*** | (2006.01) |

(52) U.S. Cl.

CPC ..... *E03C 1/057* (2013.01); *Y10T 29/49826* (2015.01); *E03C 1/0401* (2013.01)

(58) Field of Classification Search

USPC ..... 4/695

See application file for complete search history.

(56) References Cited

U.S. PATENT DOCUMENTS

| | | | |
|---|---|---|---|
| 3,998,240 | A | 12/1976 | Liautaud |
| 4,037,624 | A | 7/1977 | Turner et al. |
| 4,186,761 | A | 2/1980 | Guarnieri |
| 4,353,056 | A | 10/1982 | Tsikos |
| 4,623,451 | A | 11/1986 | Oliver |
| 4,667,987 | A | 5/1987 | Knebel |
| 4,749,126 | A | 6/1988 | Kessener |
| 4,762,611 | A | 8/1988 | Schipper |
| 4,849,098 | A | 7/1989 | Wilcock et al. |
| 4,901,922 | A | 2/1990 | Kessener |
| 4,915,347 | A | 4/1990 | Iqbal et al. |
| 4,955,535 | A | 9/1990 | Tsutsui et al. |
| 4,998,673 | A | 3/1991 | Pilolla |
| 5,126,041 | A | 6/1992 | Weber |
| 5,171,429 | A | 12/1992 | Yasuo |
| 5,220,488 | A | 6/1993 | Denes |
| 5,224,509 | A | 7/1993 | Tanaka et al. |
| 5,232,008 | A | 8/1993 | Jeffress et al. |
| 5,276,600 | A | 1/1994 | Takase et al. |
| 5,388,287 | A | 2/1995 | Tischler et al. |
| 5,458,154 | A | 10/1995 | Niemann et al. |
| 5,566,702 | A | 10/1996 | Philipp |
| 5,669,417 | A | 9/1997 | Lian-Jie |
| 5,758,688 | A | 6/1998 | Hamanaka et al. |
| 5,873,387 | A | 2/1999 | Weber et al. |

(Continued)

FOREIGN PATENT DOCUMENTS

| | | |
|---|---|---|
| CN | 201250949 Y | 6/2009 |
| CN | 201496622 | 6/2010 |

(Continued)

OTHER PUBLICATIONS

Chicago Faucets brochure, "Electronic Faucets," dated Jun. 2008, 16 pgs.

(Continued)

*Primary Examiner* — Huyen Le

(74) *Attorney, Agent, or Firm* — Faegre Baker Daniels LLP

(57) ABSTRACT

An electrically non-conductive mounting assembly is disclosed for coupling an electronic faucet to a sink deck. The mounting assembly includes a spout insulator configurable to attach to a delivery spout and a mounting bracket configured to attach to an underside of the sink deck.

20 Claims, 7 Drawing Sheets

(56) References Cited

U.S. PATENT DOCUMENTS

| | | | | |
|---|---|---|---|---|
| 5,918,855 | A * | 7/1999 | Hamanaka et al. | 251/129.04 |
| 5,942,733 | A | 8/1999 | Allen et al. | |
| 6,014,985 | A | 1/2000 | Warshawsky | |
| 6,018,828 | A * | 2/2000 | Loschelder | 4/695 |
| 6,021,960 | A | 2/2000 | Kehat | |
| 6,082,407 | A | 7/2000 | Paterson et al. | |
| 6,126,290 | A | 10/2000 | Veigel | |
| 6,192,530 | B1 | 2/2001 | Dai | |
| 6,202,980 | B1 | 3/2001 | Vincent et al. | |
| 6,209,153 | B1 * | 4/2001 | Segien, Jr. | 4/695 |
| 6,294,786 | B1 | 9/2001 | Marcichow et al. | |
| 6,370,712 | B1 | 4/2002 | Burns et al. | |
| 6,370,965 | B1 | 4/2002 | Knapp | |
| 6,382,030 | B1 | 5/2002 | Kihara et al. | |
| 6,385,794 | B1 | 5/2002 | Miedzius et al. | |
| 6,385,798 | B1 | 5/2002 | Burns et al. | |
| 6,434,765 | B1 | 8/2002 | Burns et al. | |
| 6,452,514 | B1 | 9/2002 | Philipp | |
| 6,513,787 | B1 | 2/2003 | Jeromson et al. | |
| 6,523,193 | B2 | 2/2003 | Saraya | |
| 6,548,192 | B2 | 4/2003 | Chen | |
| 6,548,193 | B2 | 4/2003 | Chen | |
| 6,551,722 | B2 | 4/2003 | Jonte et al. | |
| 6,558,816 | B2 | 5/2003 | Chen | |
| 6,619,320 | B2 | 9/2003 | Parsons | |
| 6,659,124 | B2 | 12/2003 | Burns et al. | |
| 6,716,345 | B2 | 4/2004 | Snyder | |
| 6,729,349 | B2 | 5/2004 | Brandebusemeyer | |
| 6,734,685 | B2 | 5/2004 | Rudrich | |
| 6,757,921 | B2 | 7/2004 | Esche | |
| 6,764,775 | B2 | 7/2004 | Chen | |
| 6,770,376 | B2 | 8/2004 | Chen | |
| 6,770,384 | B2 | 8/2004 | Chen | |
| 6,792,629 | B2 | 9/2004 | Nelson et al. | |
| 6,803,133 | B2 | 10/2004 | Chen | |
| 6,805,458 | B2 | 10/2004 | Schindler et al. | |
| 6,874,527 | B2 | 4/2005 | Meeder | |
| 6,909,101 | B2 | 6/2005 | Nishioka | |
| 6,962,168 | B2 | 11/2005 | McDaniel et al. | |
| 7,008,073 | B2 | 3/2006 | Stuhlmacher, II | |
| 7,017,600 | B2 | 3/2006 | Klein | |
| 7,104,519 | B2 | 9/2006 | O'Maley et al. | |
| 7,150,293 | B2 | 12/2006 | Jonte | |
| 7,174,577 | B2 | 2/2007 | Jost et al. | |
| 7,175,158 | B2 | 2/2007 | Thomas | |
| 7,201,175 | B2 | 4/2007 | DeBoer et al. | |
| 7,228,874 | B2 | 6/2007 | Bolderheij et al. | |
| 7,258,781 | B2 | 8/2007 | Warren et al. | |
| 7,344,902 | B2 | 3/2008 | Basin et al. | |
| 7,377,661 | B2 | 5/2008 | Douglass | |
| 7,406,980 | B2 | 8/2008 | Pinette | |
| 7,415,991 | B2 | 8/2008 | Meehan et al. | |
| 7,434,960 | B2 | 10/2008 | Stuhlmacher, II | |
| 7,464,418 | B2 | 12/2008 | Seggio et al. | |
| 7,467,874 | B2 | 12/2008 | Gautschi et al. | |
| 7,518,381 | B2 | 4/2009 | Lamborghini et al. | |
| 7,537,023 | B2 | 5/2009 | Marty et al. | |
| 7,624,757 | B2 | 12/2009 | Schmitt et al. | |
| 7,627,909 | B2 * | 12/2009 | Esche | 4/623 |
| 7,628,512 | B2 | 12/2009 | Netzel, Sr. et al. | |
| 7,631,372 | B2 | 12/2009 | Marty et al. | |
| 7,633,055 | B2 | 12/2009 | Nall et al. | |
| 7,666,497 | B2 | 2/2010 | Takatsuki et al. | |
| 7,690,395 | B2 | 4/2010 | Jonte et al. | |
| 7,717,133 | B2 | 5/2010 | Pinette et al. | |
| 7,721,761 | B2 | 5/2010 | Thomas | |
| 7,748,409 | B2 | 7/2010 | Pinette et al. | |
| 7,766,043 | B2 | 8/2010 | Thomas et al. | |
| 7,793,677 | B2 | 9/2010 | Pinette | |
| 7,806,141 | B2 | 10/2010 | Marty et al. | |
| 7,819,137 | B2 | 10/2010 | Nelson et al. | |
| 7,819,541 | B2 | 10/2010 | Kunkel | |
| 7,850,323 | B2 | 12/2010 | Keiper et al. | |
| 7,883,261 | B2 | 2/2011 | Yu | |
| 7,896,025 | B2 | 3/2011 | Hanson | |
| 8,127,782 | B2 | 3/2012 | Jonte et al. | |
| 8,162,236 | B2 | 4/2012 | Rodenbeck et al. | |
| 8,198,979 | B2 | 6/2012 | Haag et al. | |
| 8,277,070 | B1 | 10/2012 | Schwarz | |
| 8,438,672 | B2 | 5/2013 | Reeder et al. | |
| 8,453,669 | B2 | 6/2013 | Veros et al. | |
| 2002/0150798 | A1 | 10/2002 | Jonte et al. | |
| 2003/0213062 | A1 | 11/2003 | Honda et al. | |
| 2004/0179351 | A1 | 9/2004 | Patterson | |
| 2005/0257628 | A1 | 11/2005 | Nikaido et al. | |
| 2005/0279676 | A1 | 12/2005 | Izzy et al. | |
| 2006/0124183 | A1 | 6/2006 | Kuo | |
| 2006/0157127 | A1 | 7/2006 | Bars et al. | |
| 2006/0157128 | A1 | 7/2006 | Frackowiak et al. | |
| 2006/0283511 | A1 | 12/2006 | Nelson | |
| 2006/0289343 | A1 | 12/2006 | Schmitt et al. | |
| 2007/0031624 | A1 | 2/2007 | Brosius | |
| 2007/0069418 | A1 | 3/2007 | Liao et al. | |
| 2007/0121326 | A1 | 5/2007 | Nall et al. | |
| 2007/0137714 | A1 | 6/2007 | Meehan et al. | |
| 2007/0241977 | A1 | 10/2007 | Vance | |
| 2007/0273394 | A1 | 11/2007 | Tanner et al. | |
| 2008/0099091 | A1 | 5/2008 | Benstead | |
| 2008/0109956 | A1 | 5/2008 | Bayley et al. | |
| 2008/0178935 | A1 | 7/2008 | Thomas | |
| 2008/0178954 | A1 | 7/2008 | Pinette et al. | |
| 2008/0185060 | A1 | 8/2008 | Nelson | |
| 2008/0257706 | A1 | 10/2008 | Haag | |
| 2008/0291660 | A1 | 11/2008 | Gautschi et al. | |
| 2008/0308165 | A1 | 12/2008 | Meehan et al. | |
| 2009/0000026 | A1 | 1/2009 | Hanson | |
| 2009/0039176 | A1 | 2/2009 | Davidson et al. | |
| 2009/0154524 | A1 | 6/2009 | Girelli | |
| 2009/0276954 | A1 | 11/2009 | Davidson | |
| 2010/0117660 | A1 | 5/2010 | Dougas et al. | |
| 2010/0180375 | A1 | 7/2010 | Meehan et al. | |
| 2010/0242274 | A1 | 9/2010 | Rosenfeld et al. | |
| 2011/0003144 | A1 | 1/2011 | Nakamura et al. | |
| 2011/0012378 | A1 | 1/2011 | Ueno et al. | |
| 2011/0016625 | A1 | 1/2011 | Marty et al. | |
| 2011/0187957 | A1 | 8/2011 | Kim et al. | |
| 2011/0209781 | A1 | 9/2011 | Fath | |
| 2012/0055886 | A1 | 3/2012 | Hunter et al. | |
| 2012/0188179 | A1 | 7/2012 | Karlsson | |
| 2012/0200517 | A1 | 8/2012 | Nikolovski | |
| 2012/0223805 | A1 | 9/2012 | Haag et al. | |
| 2012/0267493 | A1 | 10/2012 | Meehan et al. | |
| 2013/0098489 | A1 | 4/2013 | Meehan et al. | |
| 2013/0186482 | A1 | 7/2013 | Veros et al. | |

FOREIGN PATENT DOCUMENTS

| | | |
|---|---|---|
| CN | 201875209 | 6/2011 |
| JP | 2001120448 | 5/2001 |
| JP | 2002242246 | 8/2002 |
| JP | 2003232059 | 8/2003 |
| JP | 2004116083 A | 4/2004 |
| WO | WO2006/098795 | 9/2006 |
| WO | WO 2007/059051 | 5/2007 |
| WO | WO2007/123639 | 11/2007 |
| WO | WO 2008/088534 | 7/2008 |
| WO | WO 2009/158498 | 12/2009 |
| WO | WO 2010/120070 | 10/2010 |

OTHER PUBLICATIONS

Moen PureTouch Illustrated Parts, Available At Least As Early As 2003, 1 page.

Dave Van Ess, Capacitive Sensing Builds a Better Water-Cooler Control, Cypress Semiconductor Corp. Nov. 2007, 9 pages.

Aviation Faucet System, Product Brochure, Franke Aquarotter GmbH, downloaded Oct. 1, 2012, 6 pages.

Springking Industry Col, Limited, Touch Sensor Faucet, Product Specification, downloaded Oct. 1, 2012.

Moen PureTouch Owner's Manual INS412A, Available At Least As Early As 2003, 18 pages.

(56) References Cited

OTHER PUBLICATIONS

Moen, Single Handle Filtering Faucet, INS1169-4/06, 6 pages, dated Apr. 2006.
Wavelock Advanced Technology Co., Ltd, Introducing Wavelock Advanced Technorogy's Decorative Metallic Tape and Sheet, 18 pages, available at least as early as Nov. 2012.
Sloan Valve Company, Optima Plus EBF-750 product description, dated Feb. 2011, 2 pages.
Sloan Valve Company, Installation Instructions and User Manual for Sloan EAF Gooseneck Series Faucets, Code No. 0816409, dated Jul. 2011, 10 pages.
Grohe, Europlus E "Touch-Free" Centerset Product Catalog, downloaded from http://www.grohecatalog.com/print/36212 Nov. 6, 2013, 3 pages.
Photograph of "Current Parts," 1 page, available at least as early as Oct. 2010.

* cited by examiner

MOUNTING BRACKET FOR ELECTRONIC KITCHEN FAUCET

BACKGROUND AND SUMMARY OF THE INVENTION

The present invention relates to the field of electronic faucets, and in particular to an electrically insulating mounting bracket for electronic kitchen faucets, such as those that include capacitive sensing technologies for automated use.

Automatic or electronic faucets, such as those including capacitive control or sensing features, are becoming increasingly popular, particularly in residential households. Such faucets tend to be at least partially formed of metal or other electrically conductive material. Capacitive sensing faucets may be mounted to a mounting deck, such as a kitchen sink, that may be made of metal, such as stainless steel, for example. In such instances, an electrically non-conductive mounting assembly may be used to insulate the metal capacitive sensing components of the faucet from the metal sink.

While electrically insulating faucet mounting assemblies are known in the prior art, they have typically consisted of multiple interconnected components that increase the complexity of manufacturing and installation. For example, forgetting a component during installation of conventional mounting assemblies to the sink deck may result in reduced capacitive performance of the faucet when secured to the sink deck. As such, an improved mounting assembly is desirable.

The present disclosure provides an electrically non-conductive mounting assembly for coupling an electronic faucet, illustratively a capacitive sensing faucet, to an electrically conductive sink deck. In an illustrative embodiment, the mounting assembly includes a spout insulator configured to attach to a delivery spout and which has a top shank aperture for receipt of a metal spout shank extending from the delivery spout. The mounting assembly also illustratively includes a mounting bracket configured to attach to an underside of the sink deck below a sink deck aperture configured to receive the metal spout shank of the delivery spout. The metal spout shank extends through the top shank aperture of the spout insulator, through the sink deck aperture, and through a bottom shank aperture of the mounting bracket. The mounting bracket illustratively includes a boss defining the bottom shank aperture, wherein the boss includes a projecting lip that is sufficient in height to extend into the sink deck aperture and project above a bottom surface of the sink deck when the mounting bracket and the spout insulator are attached to the sink deck. In certain illustrative embodiments, the boss of the mounting bracket is radially spaced intermediate internal walls of the spout insulator and the metal spout shank. The boss of the mounting bracket provides radial spacing, and thereby electrical isolation, between the metal spout shank and the sink deck.

According to an illustrative embodiment of the present disclosure, a mounting assembly is provided for coupling an electronic faucet to a sink deck having a top surface, a bottom surface, and a wall defining a sink deck aperture extending between the top surface and the bottom surface of the sink deck. The mounting assembly includes a delivery spout, and a spout insulator having a top surface, a bottom surface, and internal walls defining a top shank aperture. The top surface of the spout insulator is configured to attach to the delivery spout, the bottom surface of the spout insulator is configured to abut the sink deck, and the top shank aperture of the spout insulator is configured to be disposed over the sink deck aperture. The mounting bracket is configured to attach to the bottom surface of the sink deck below the sink deck aperture, the mounting bracket including a boss defining a bottom shank aperture. The boss includes a projecting lip sufficient in height to extend into the sink deck aperture and project above the bottom surface of the sink deck when the mounting bracket is attached to the bottom surface of the sink deck. The mounting bracket is formed of an electrically non-conductive material. A metal shank is connected to the delivery spout and extends through the top shank aperture of the spout insulator, the sink deck aperture, and the bottom shank aperture of the mounting bracket, whereby when the mounting bracket is attached to the bottom surface of the sink deck, the shank is spaced from the sink deck.

According to a further illustrative embodiment of the present disclosure, a mounting assembly is provided for use with an electronic faucet to attach the faucet to a sink deck having a bottom surface and a sink deck aperture, the mounting assembly including an electrically non-conductive mounting bracket configured to attach to the underside of the sink deck. The mounting bracket includes a boss defining a bottom shank aperture. The boss includes a projecting lip, and the projecting lip is sufficient in height to extend into the sink deck aperture and project above a bottom surface of the sink deck when the mounting bracket is attached to the bottom surface of the sink deck. An electrically conductive shank extends downwardly from above the sink deck, through the sink deck aperture and the bottom shank aperture of the mounting bracket.

According to another illustrative embodiment of the present disclosure, a method for attaching a mounting assembly to a sink deck includes the steps of attaching a delivery spout including a metal shank to a spout insulator having a top shank aperture, extending the shank through the top shank aperture of the spout insulator, disposing the spout insulator over a sink deck aperture, disposing a mounting bracket under the sink deck aperture such that a projecting lip of a boss of the mounting bracket extends into the sink deck aperture and is spaced from the spout insulator, extending the shank through the boss of the mounting bracket, and fastening the mounting bracket and the spout insulator to the sink deck, whereby the shank is spaced from the sink deck.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

The present disclosure describes an electrically non-conductive mounting assembly for coupling an electrically conductive, electronic faucet to a sink deck. The electronic faucet may be a faucet including capacitive sensing, for example, as described in any of the following U.S. patents, all of which are hereby incorporated by reference in their entireties: U.S. Pat. No. 6,962,168 to McDaniel et al., entitled "CAPACITIVE TOUCH ON/OFF CONTROL FOR AN AUTOMATIC RESIDENTIAL FAUCET", issued Nov. 8, 2005; U.S. Pat. No. 7,150,293 to Jonte, entitled "MULTI-MODE HANDS FREE AUTOMATIC FAUCET", issued Dec. 16, 2006; and U.S. Pat. No. 7,690,395 to Jonte et al., entitled "MULTI-MODE HANDS FREE AUTOMATIC FAUCET", issued Apr. 6, 2010.

The illustrative mounting assembly of the present disclosure as further detailed below, includes a spout insulator having a top shank aperture to receive an electrically conductive spout shank extending from the delivery spout to which the spout insulator attaches. At least a portion of the illustrative delivery spout is electrically conductive, and electrically coupled to the spout shank, to provide for capacitive sensing. The illustrative mounting assembly also includes a mounting bracket configured to attach to an underside of the sink deck below a sink deck aperture and configured to receive the spout shank. The spout shank illustratively extends through the top shank aperture of the spout insulator, through the sink deck aperture, and through a bottom shank aperture of the mounting bracket.

The mounting bracket illustratively includes a boss defining the bottom shank aperture. The boss includes a projecting lip sufficient in height to extend into the sink deck aperture and project above a bottom surface of the sink deck when the mounting bracket and the spout insulator receive the spout shank and are attached to the sink deck. When the mounting bracket and the spout insulator are attached to the sink deck, the boss of the mounting bracket is radially spaced intermediate the metal shank and the sink deck, thereby electrically isolating the metal shank from the sink deck.

Figure 1:
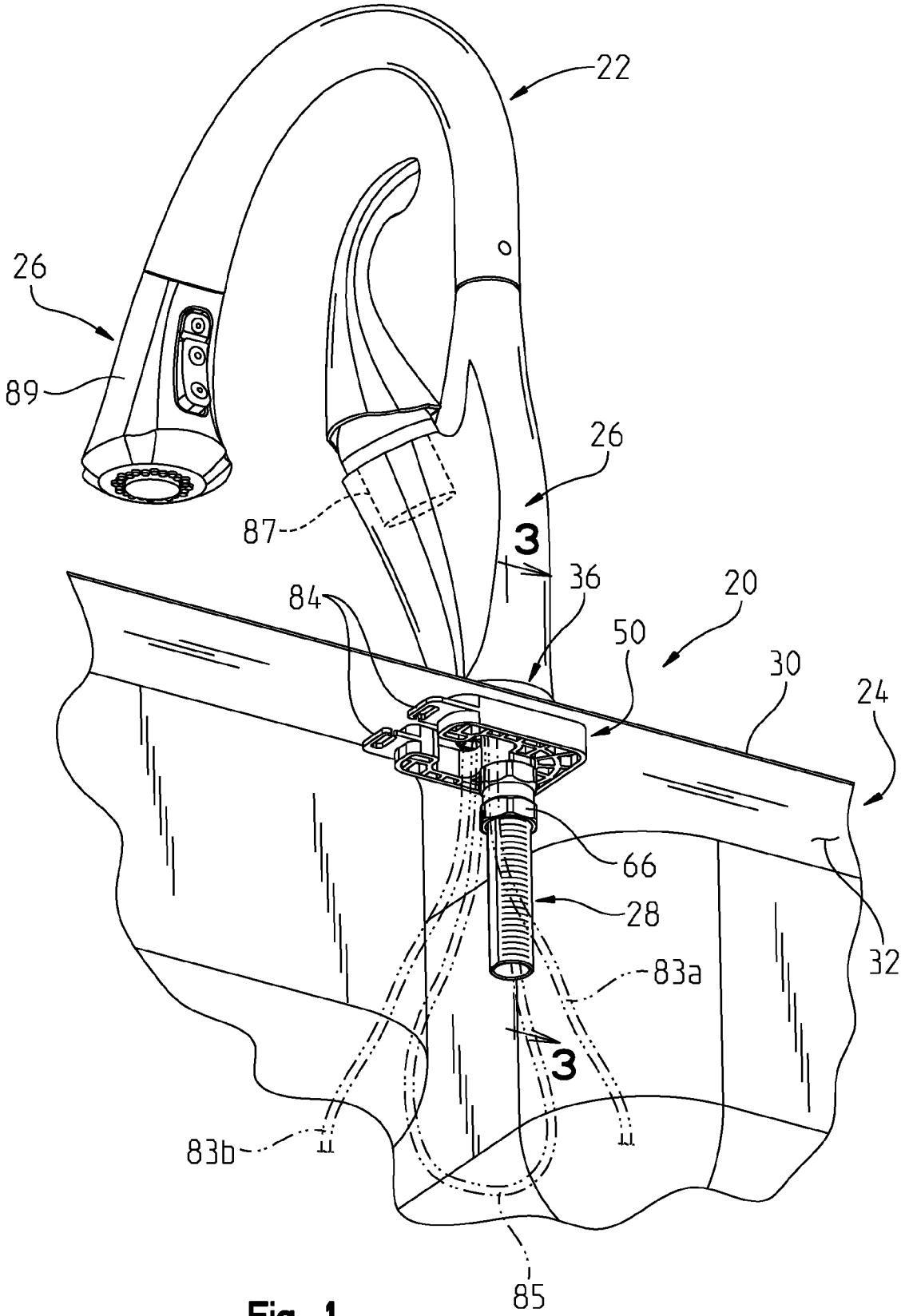
FIG. 1 is a bottom perspective view of a mounting assembly according to an illustrative embodiment of the present disclosure that includes a mounting bracket and a spout insulator connected to an electronic faucet, the mounting assembly coupling the electronic faucet to a sink deck while electrically isolating a metal shank of the faucet from the sink deck.

Referring to FIG. 1, illustrative mounting assembly 20 is shown as coupling electronic faucet 22 to sink deck 24. Electronic faucet 22 illustratively includes delivery spout 26 and electrically conductive (e.g., metal) spout shank 28 connected to and extending downwardly from delivery spout 26. At least a portion of the delivery spout 26 is illustratively electrically conductive (e.g., formed of metal) and electrically coupled to the spout shank 28 to provide for capacitive sensing. Moreover, the spout shank 28 may be electrically coupled to a controller (not shown) to provide capacitive sensing functionality, wherein an electrically openable valve (not shown) may be controlled in response to a user, for example, touching an electrically conductive portion of the delivery spout 26.

Figure 2:
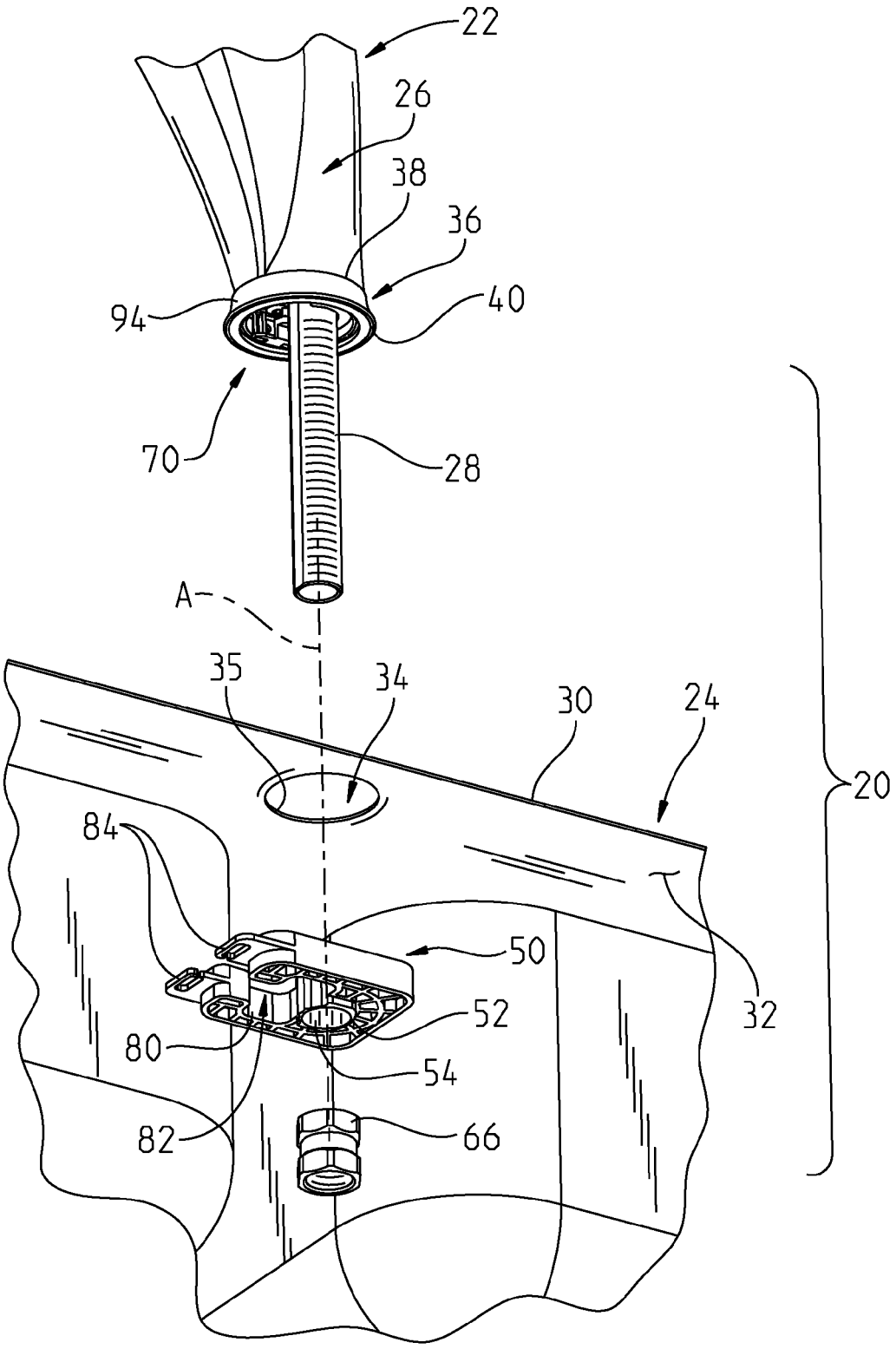
FIG. 2 is an exploded perspective view of the mounting assembly of FIG. 1.
Figure 8:
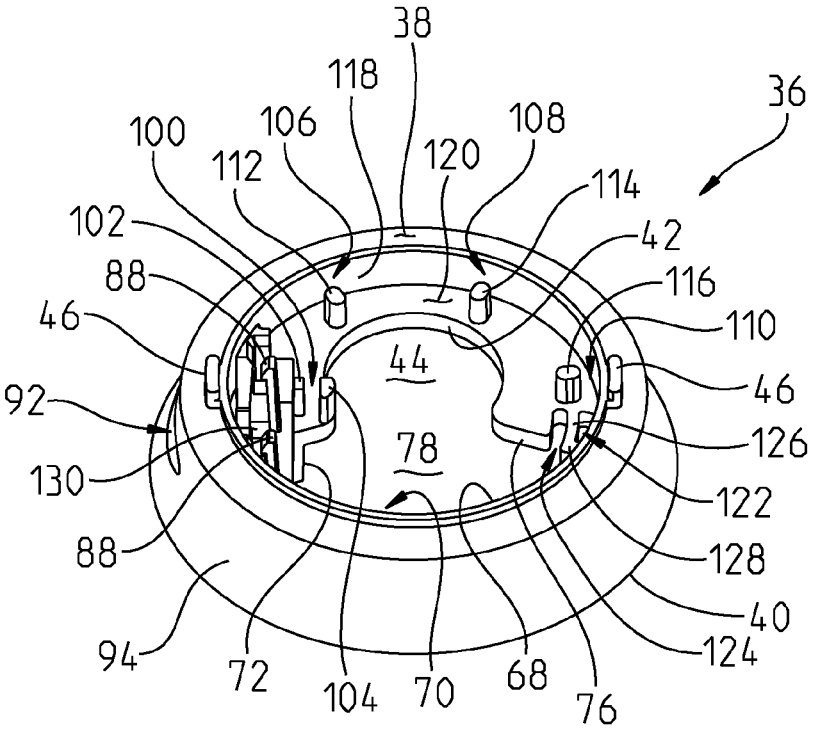
FIG. 8 is a top perspective view of the spout insulator of FIG. 6.

Sink deck 24 includes top surface 30, underside or bottom surface 32, and sink deck aperture 34 that is defined by internal wall 35 (FIG. 2) extending between top surface 30 and bottom surface 32 of sink deck 24. Sink deck 24 may comprise any conventional mounting deck, for example, a relatively thick (approximately 0.5 inches thick) cast iron/enamel sink deck or a relatively thin (approximately 0.031 inches thick) stainless steel sink deck. Spout insulator 36, as shown in FIG. 2, includes top surface 38 (FIG. 8), bottom surface 40 (FIG. 6), and internal wall 42 defining top shank aperture 44 (FIG. 8). Top surface 38 of spout insulator 36 is configured to attach to delivery spout 26, as shown in FIG. 2.

Figure 7:
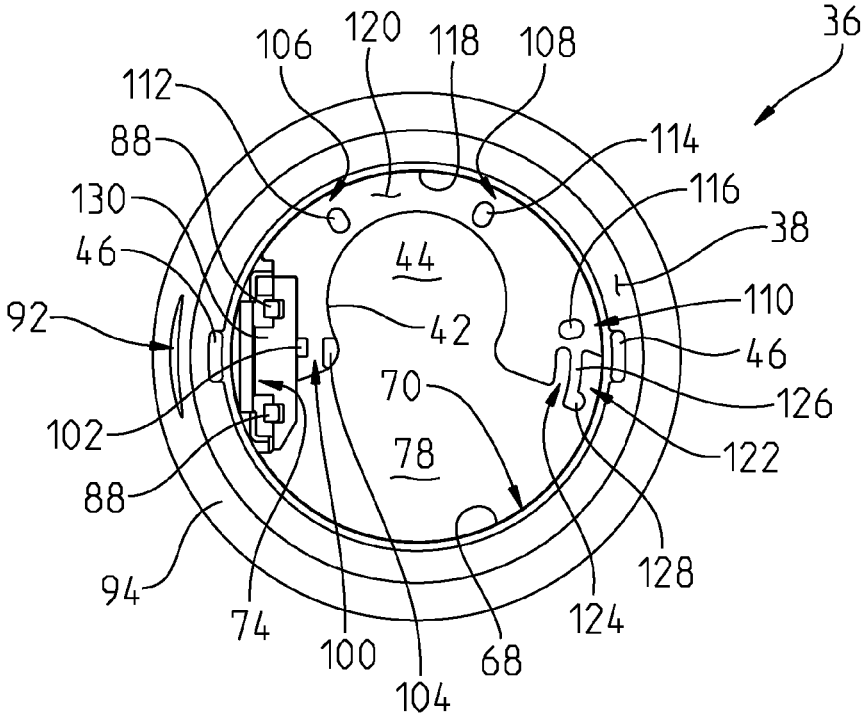
FIG. 7 is a top plan view of the spout insulator of FIG. 6.
Figure 9:
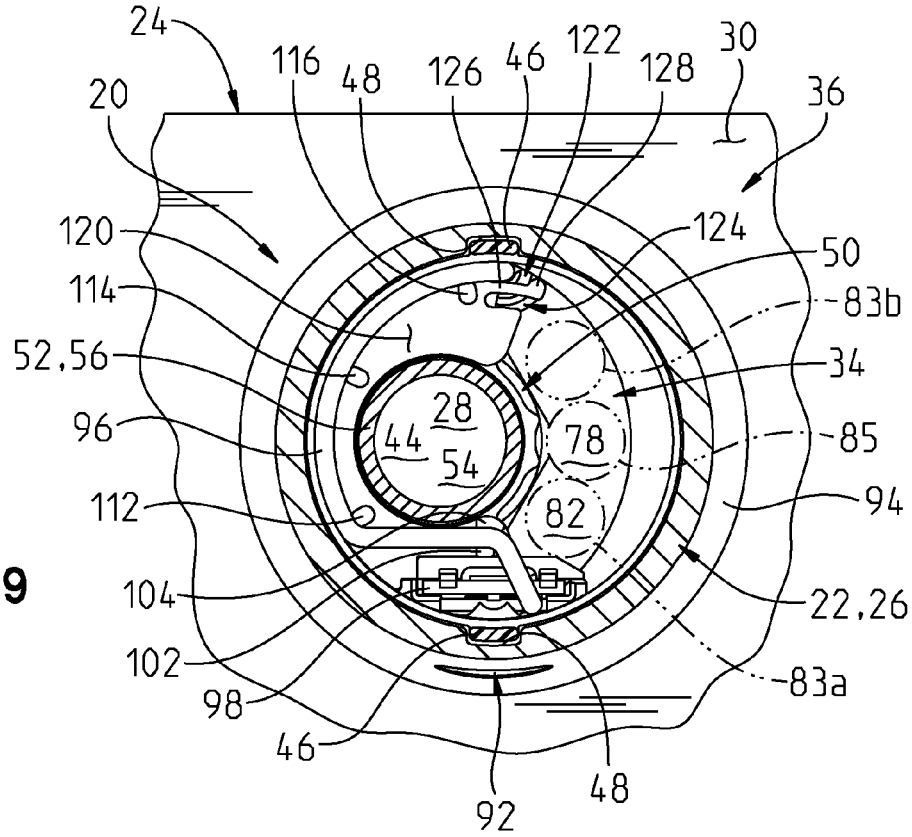
FIG. 9 is a cross-sectional view taken along line 9-9 of FIG. 3, showing the keying of the spout insulator to the delivery spout of FIG. 1.

Referring to FIGS. 7-9, a keyed connection between top surface 38 of spout insulator 36 and delivery spout 26 is shown. In particular, top surface 38 of spout insulator 36 includes a pair of upwardly extending prongs 46 that project into corresponding notches 48 (FIG. 9) on a lower or distal end of delivery spout 26 to appropriately key spout insulator 36 to delivery spout 26.

Referring further to FIG. 2, spout insulator 36 includes bottom surface 40 that is configured to abut top surface 30 of sink deck 24 when spout insulator 36 is connected to sink deck 24, as shown in FIG. 1. Further, top shank aperture 44 of spout insulator 36 is configured to be disposed over sink deck aperture 34 (FIG. 2). Spout insulator 36, and in particular its use to illustratively house electronics, such as a light emitting device, will be discussed in further detail below.

Figure 3:
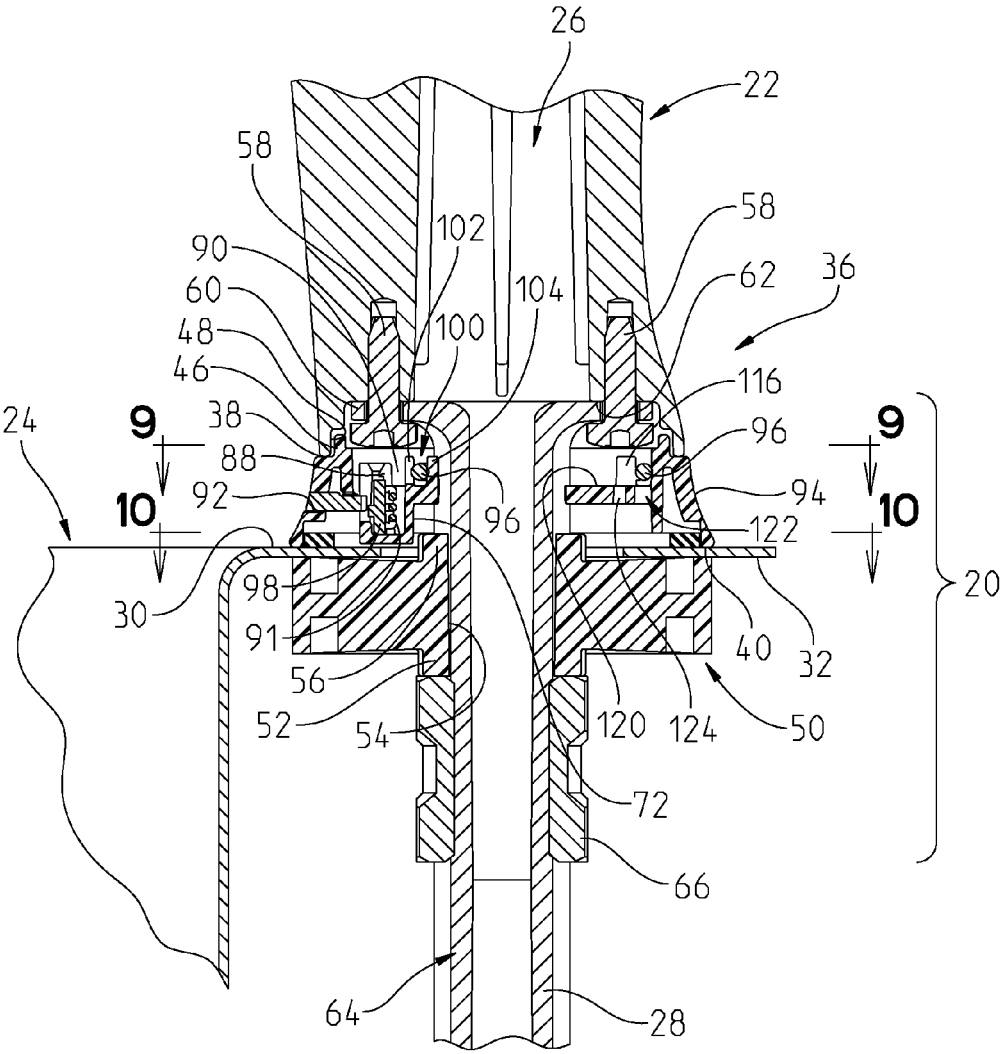
FIG. 3 is a cross-sectional view of the mounting assembly of FIG. 1 taken along line 3-3.

With further reference to FIG. 2, mounting bracket 50 is configured to attach to bottom surface 32 of sink deck 24 below sink deck aperture 34. Referring to FIGS. 3-6, mounting bracket 50 illustratively includes boss 52 defining bottom shank aperture 54. Boss 52 of mounting bracket 50 includes upwardly projecting lip 56 that is sufficient in height to extend into sink deck aperture 34 and project above bottom surface 32 of sink deck 24 when mounting bracket 50 is attached to bottom surface 32 of sink deck 24, as shown in FIGS. 1 and 3. In thin sink deck installations, the upwardly extending projecting lip 56 may extend through sink deck aperture 34 and project above top surface 30 of sink deck 24. While the following description and associated drawings detail a thin sink deck installation, it should be appreciated that a thick sink deck installation is substantially similar but with the spout insulator 36 being further axially spaced from the mounting bracket 50.

Referring to FIG. 3, metal spout shank 28 is illustratively connected to delivery spout 26 via fasteners such as screws 58 extending through a surface on top portion 60 of metal spout shank 28 to attach it to internal bottom surface 62 of spout 26 of faucet 22. Top portion or flange 60 of metal spout shank 28 has a larger diameter than lower portion 64 of metal spout shank 28 that extends through apertures 44 and 54 of spout insulator 36 and mounting bracket 50, respectively. More particularly, metal spout shank 28 extends downwardly from a lower end of delivery spout 26 of faucet 22 such that, when mounting assembly 20 mounts and attaches electronic faucet 22 to sink deck 24, metal spout shank 28 extends through top shank aperture 44 of spout insulator 36, through sink deck aperture 34, and through bottom shank aperture 54 of mounting bracket 50.

A fastener, which may be nut 66, for example, engages with metal spout shank 28 to firmly attach mounting assembly 20 to sink deck 24. For example, nut 66 threadably engages threaded metal spout shank 28 to be firmly secured against an underside of mounting bracket 50, thereby providing an upward force that urges mounting bracket 50 against bottom surface 32 of sink deck 24 and pulls spout insulator 36 tightly against top surface 30 of sink deck 24.

Figure 6:
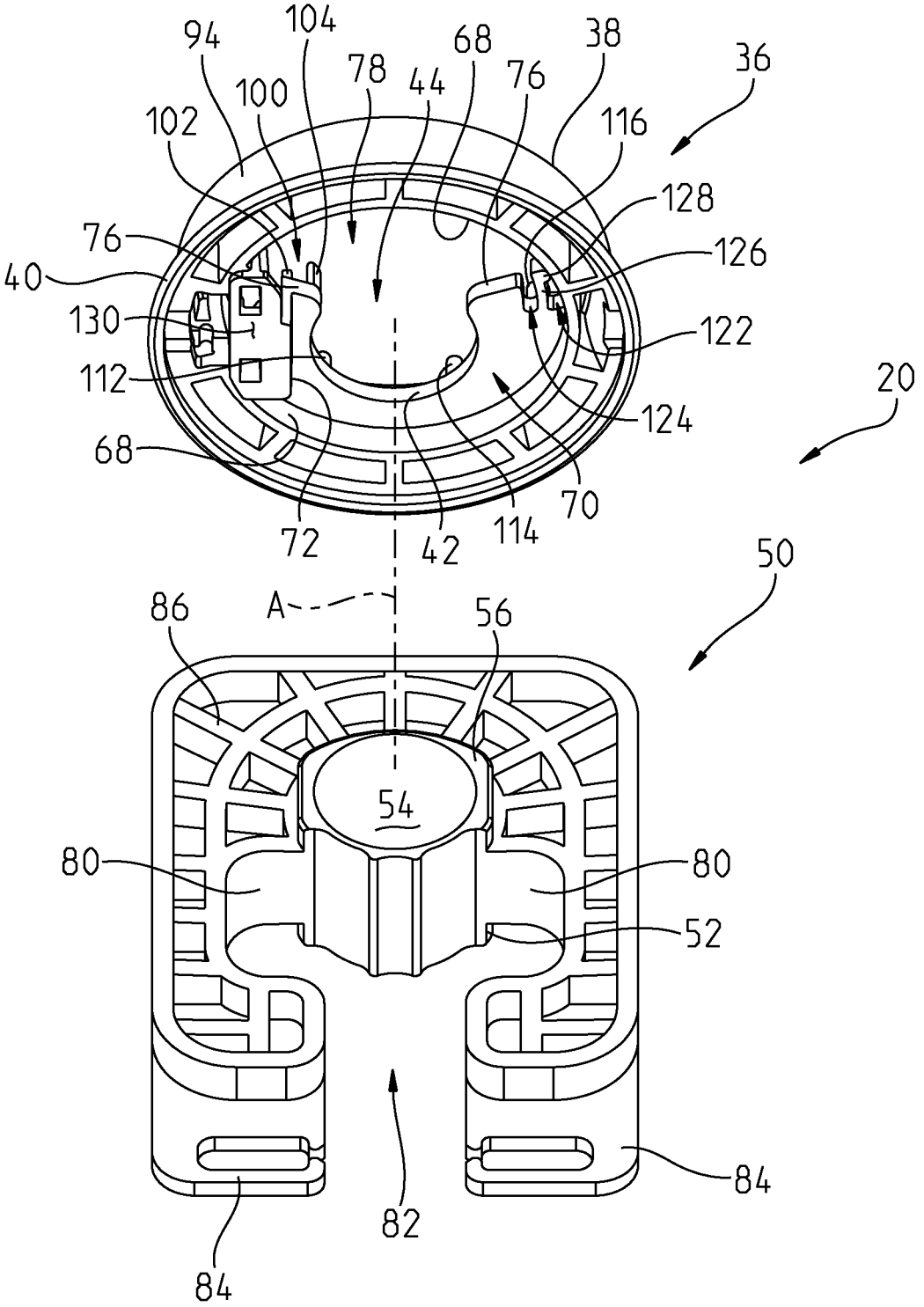
FIG. 6 is an exploded perspective view of the mounting assembly of FIG. 1, including a bottom perspective view of the spout insulator and a top perspective view of the mounting bracket.
Figure 10:
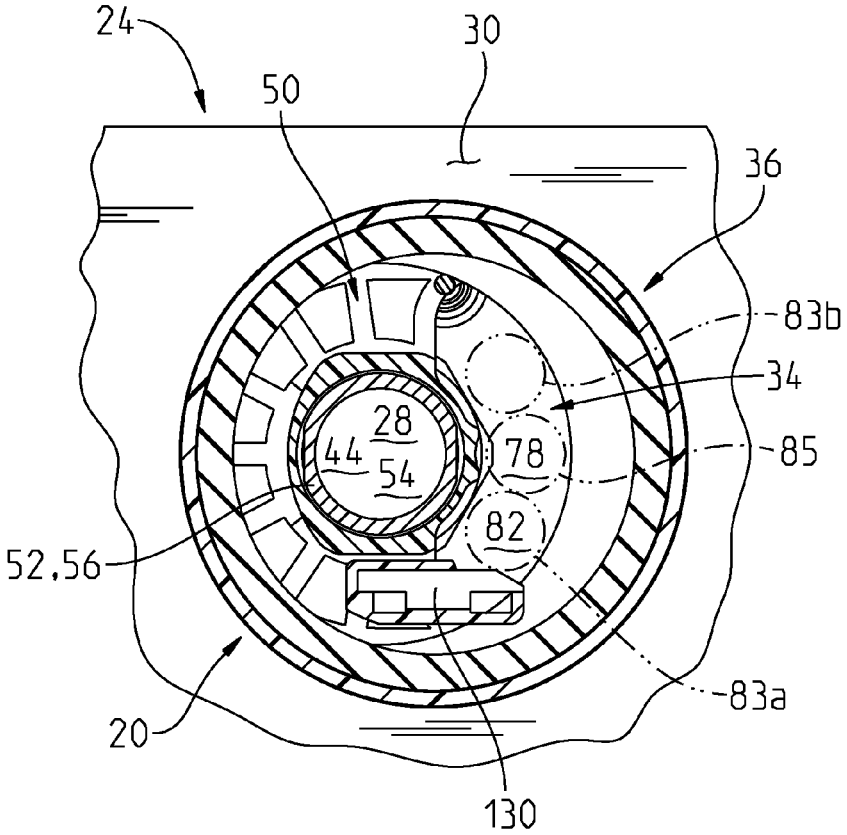
FIG. 10 is a cross-sectional view taken along line 10-10 of FIG. 3.

Referring to FIGS. 3 and 10, when mounting bracket 50 is attached to bottom surface 32 of sink deck 24, projecting lip 56 of boss 52 of mounting bracket 50 is spaced from spout insulator 36. Referring to FIGS. 3 and 6, projecting lip 56 of boss 52 of mounting bracket 50 is illustratively spaced from internal walls 42 and 68 of spout insulator 36 via axial and radial clearances. Specifically, projecting lip 56 of boss 52 of mounting bracket 50 is illustratively vertically spaced from internal walls 42 of spout insulator 36 that define top shank aperture 44 via a vertical axial clearance. Additionally, projecting lip 56 of boss 52 of mounting bracket 50 is illustratively horizontally or laterally spaced from internals walls 68 (FIG. 6) of spout insulator 36 that define bottom aperture 70 via a horizontal radial clearance. Bottom aperture 70 of spout insulator 36 is disposed below and in open communication with top shank aperture 44 of spout insulator 36, as shown in FIG. 6.

In the illustrative embodiment, disposed between walls 42 and 68 of spout insulator 36 is intermediate vertical wall 72 partially defining an LED receiving groove 74, described further below. Illustratively, the height of intermediate vertical wall 72 of spout insulator 36 is greater than the height of projecting lip 56 of boss 52 of mounting bracket 50, such that a vertical axial overlap occurs when spout insulator 36 and mounting bracket 50 are attached to a relatively thin sink deck 24 (FIGS. 1 and 3). Also, intermediate vertical wall 72 is horizontally spaced from projecting lip 56 to allow for a horizontal or lateral clearance between spout insulator 36 and mounting bracket 50.

Referring to FIGS. 6-8, internal walls 76 (FIGS. 6 and 8) and 68 (FIGS. 6 and 7) of spout insulator 36 define top tube aperture 78 that is in laterally adjacent, open relation with top shank aperture 44, or rather, at least a portion of top tube aperture 78 and top shank aperture 44 are in laterally open engagement with no walls separating the two apertures.

Mounting bracket 50 (FIG. 6) includes internal walls 80 defining bottom tube aperture 82 that is in adjacent closed relation with bottom shank aperture 54 such that bottom tube aperture 82 and bottom shank aperture 54 are separated by the side wall of boss 52. Top tube aperture 78 of spout insulator 36 is configured to be substantially laterally aligned with bottom tube aperture 82 of mounting bracket 50 when spout insulator 36 and mounting bracket 50 are attached to sink deck 24 along axis A (FIGS. 2 and 6). Axis A illustratively corresponds to the longitudinal axis of the spout shank 28. The aligned top tube aperture 78 and bottom tube aperture 82 are configured to receive tubes, for example, hot water supply tube 83*a*, cold water supply water tube 83*b*, and water outlet tube 85 (FIGS. 1, 9 and 10). As is known, hot and cold water supply tubes 83*a* and 83*b* supply hot and cold water, respectively, to a mixing valve 87 (FIG. 1) which, in turn, controls the flow rate and temperature of water delivered to water outlet tube 85. Outlet tube 85 may extend downwardly through tube apertures 78 and 82 and loop back through the spout shank 28 and delivery spout 26 to a water delivery outlet, illustratively a pull-down sprayhead 89.

Sink deck 24 may be made of a metallic material such as, for example, stainless steel. Spout insulator 36 may be made of a material that is electrically non-conductive such as, for example, a polymeric material, which may be a thermoplastic. Similarly, mounting bracket 50 may be made of a material that is electrically non-conductive such as, for example, a polymeric material, which may be a thermoplastic.

Figure 4:
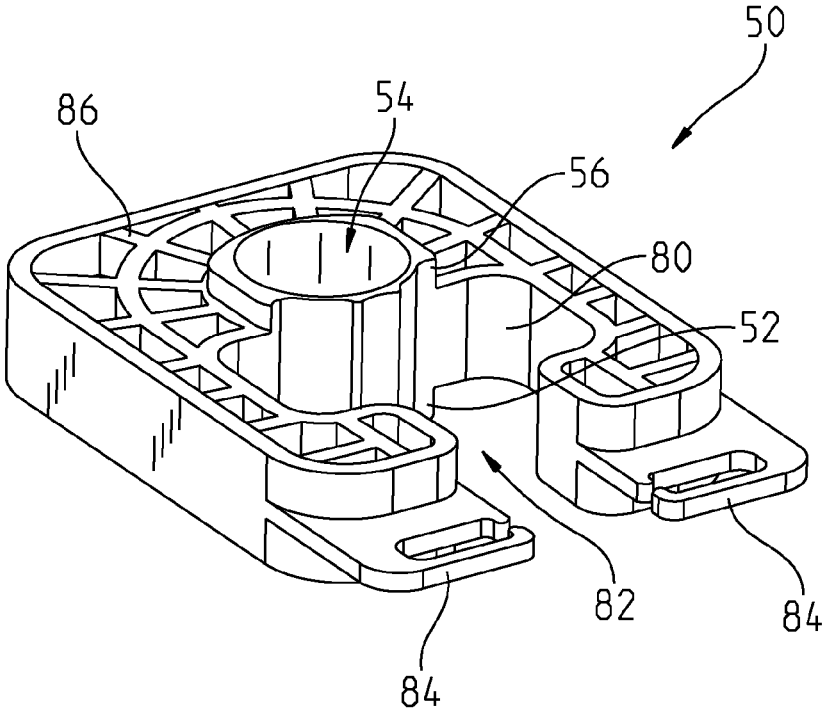
FIG. 4 is a top perspective view of the mounting bracket of the mounting assembly of FIG. 1.
Figure 5:
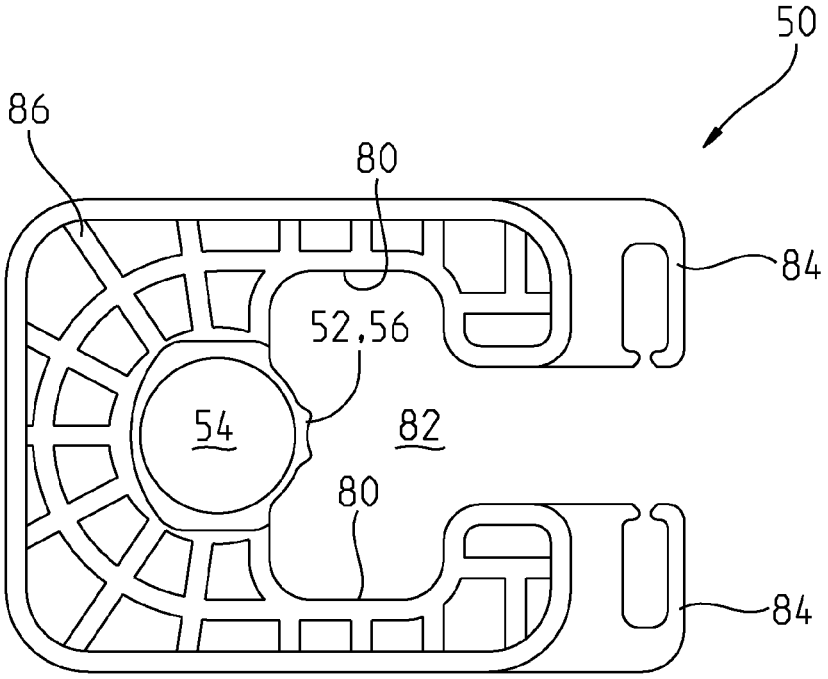
FIG. 5 is a top plan view of the mounting bracket of FIG. 4.

Referring to FIGS. 4 and 5, mounting bracket 50 includes a pair of horizontally projecting wire clips 84 spaced from bottom surface 32 of sink deck 24 when mounting bracket 50 is attached to sink deck 24, such as shown in FIG. 1. Wire clips 84 are configured to receive one or more wires (not shown), for example wires electrically coupled to the metal spout 26 for capacitive sensing. Top surface 86 of mounting bracket 50 includes a ribbed or webbed design manufactured during a molding process that creates mounting brackets 50. The ribbed design advantageously allows for increased strength properties of mounting bracket 50, while reducing material volume.

Referring to FIG. 2, after faucet 22 is attached to sink deck 24, an indicator light 98, illustratively a light emitting diode (LED), may face frontwards towards a user and away from the rear of the kitchen sink to indicate an operating mode, for example whether the faucet is on (via the display light) or off (via no display light). Referring to FIG. 8, spout insulator 36 includes LED receiving groove 74 defined by an internal wall 72 of spout insulator 36 and projecting posts 88 of spout insulator 36. Intermediate vertical wall 72 described above, and posts 88 define a LED wire receiving groove 90 to receive LED wire 91 (FIG. 3). Intermediate vertical wall 72 separates grooves 74 and 90 from the walls defining top shank aperture 44 and top tube aperture 78. An LED display light may be displayed to a user via opening 92 defined in external peripheral walls 94 of spout insulator 36.

Referring to FIGS. 3 and 9, a wire, such as wire 96 shown in FIGS. 3 and 9 may extend from LED device 98, through notch 100 defined by upwardly projecting pegs 102 and 104 (FIGS. 6 and 8) then through notches 106, 108 and 110 (FIG. 7), each respectively defined between pegs 112, 114, and 116, respectively (FIG. 7-9), and internal top wall 118 of spout insulator 36. Pegs 112, 114 and 116 upwardly project from intermediate top surface 120 (FIGS. 7-9) of spout insulator 36. Wire 96 (FIG. 9) drops through notch 122 (FIGS. 7 and 9) or potentially through notch 124. Notches 122 and 124 are defined by the walls formed within intermediate top surface 120 of spout insulator 36 and disposed inwardly from walls 76 below intermediate top surface 120 defining top tube aperture 78, as described above and further below. Notches 122 and 124 are separated by resilient arm or protrusion 126 (FIG. 7) having bead or retainer 128 to help secure wire 96 within, for example notch 122.

FIG. 9 is a top cross-sectional view showing wire 96 being received in notches 100, 106, 108, and 110, to be dropped down below bottom surface 32 of sink deck 24. FIG. 9 also shows LED device 98 positioned in LED receiving groove 74. FIG. 10 shows a cross-sectional view from top to bottom, the view being taken across the bottommost portion of spout insulator 36 when it is attached to sink deck 24, thereby showing bottom surface 130 that defines LED receiving groove 74, which receives LED device 98 as shown in FIG. 9. The water tube 83*a*, 83*b*, 85 are shown in phantom in representative positions for extending through bottom tube aperture 82 of mounting bracket 50, through sink deck aperture 34, and through top tube aperture 78 of spout insulator 36 for connection to delivery spout 26 of faucet 22.

As described above, interior internal walls 42 disposed below intermediate top surface 120 define top shank aperture 44 of spout insulator 36 for receiving spout shank 28. As illustrated in FIG. 8, top shank aperture 44 is in adjacent open relationship with top tube aperture 78 of spout insulator 36. Walls 76, disposed below intermediate top surface 120 of spout insulator 36, along with internal walls 68 of spout insulator 36 define top tube aperture 78 for receiving tubes 83*a*, 83*b*, 85.

Referring back to FIG. 6, which shows a bottom perspective view of spout insulator 36, bottom aperture 70 is disposed below top shank aperture 44 and top tube aperture 78, and is defined by internal wall 68 (FIGS. 6 and 7) and intermediate vertical wall 72 (FIGS. 6 and 8) of spout insulator 36.

To attach mounting assembly 20 and thereby faucet 22 to sink deck 24, delivery spout 26 is attached to spout insulator 36 having top shank aperture 44. Prongs 46 of spout insulator 36 key to notches 48 of spout 26 to appropriately position spout insulator 36 against spout 26. Referring to FIG. 2, spout shank 28 of delivery spout 26 is extended through top shank aperture 44 of spout insulator 36. Spout insulator 36 is disposed over sink deck aperture 34. Mounting bracket 50 is disposed under sink deck aperture 34 such that, when it is in abutting relation with bottom surface 32 of sink deck 24, projecting lip 56 of boss 52 of mounting bracket 50 extends axially into sink deck aperture 34 as shown in FIG. 3. Further, projecting lip 56 of boss 52 is illustratively laterally spaced from sink deck 24 and from spout insulator 36, as described above.

As shown in FIG. 1, shank 28 is extended through boss 52 of mounting bracket 50. Mounting bracket 50 is fastened via nut 66 (FIGS. 1 and 2) to spout insulator 36 to tightly fasten mounting assembly 20 and delivery spout 26 to sink deck 24, such that shank 28 will be spaced from, and electrically isolated from, sink deck 24 upon assembly of mounting assembly 20. As described above, nut 66 may threadably engage shank 28 until nut 66 abuts and is tightened against mounting bracket 50 to secure mounting bracket 50 to sink deck 24. Such tightening allows for spout insulator 36 to be firmly secured to an opposite side of sink deck 24. The above-described vertical and horizontal radial spacing of boss 52 of mounting bracket 50 from the internal walls of spout insulator 36 may further distance metal shank 28, received through top shank aperture 44 of spout insulator 36 and boss 52 of mounting bracket 50, from sink deck 24. Thus, interference of the electrical conductivity of the metal shank 28 and faucet 22 from the metal sink deck 24 is substantially prevented.

Although the invention has been described in detail with reference to certain preferred embodiments, variations and modifications exist within the spirit and scope of the invention as described and defined in the following claims.

The invention claimed is:

1. A mounting assembly for coupling an electronic faucet to a sink deck having a top surface, a bottom surface, and a wall defining a sink deck aperture extending between the top surface and the bottom surface of the sink deck, the mounting assembly comprising:

a delivery spout;

a spout insulator having a top surface, a bottom surface, and internal walls defining a top shank aperture, said top surface configured to attach to said delivery spout, said bottom surface configured to abut the sink deck, and said top shank aperture configured to be disposed over the sink deck aperture;

a mounting bracket configured to attach to said bottom surface of the sink deck below the sink deck aperture, said mounting bracket including a boss defining a bottom shank aperture, said boss including a projecting lip sufficient in height to extend into the sink deck aperture and project above the bottom surface of the sink deck, said projecting lip of said boss of said mounting bracket being spaced from internal walls of said spout insulator via a radial clearance, when said mounting bracket is attached to the bottom surface of the sink deck, the mounting bracket formed of an electrically non-conductive material; and a metal shank connected to said delivery spout and extending through said top shank aperture of said spout insulator, the sink deck aperture, and said bottom shank aperture of said mounting bracket, whereby when said mounting bracket is attached to the bottom surface of the sink deck, said shank is spaced from the sink deck.

2. The mounting assembly of claim 1, wherein, when said mounting bracket is attached to the bottom surface of the sink deck, said projecting lip of said boss of said mounting bracket is horizontally spaced from internal walls of said spout insulator defining a bottom aperture via a horizontal radial clearance, said bottom aperture of said spout insulator disposed below and in open communication with said top shank aperture of said spout insulator.

3. The mounting assembly of claim 1, further comprising a fastening device sized for receipt on said shank, whereby said fastening device attaches said mounting bracket to the sink deck.

4. The mounting assembly of claim 3, wherein the fastening device is a nut sized for receipt on said metal shank, said nut configured to threadably engage the shank to secure the mounting bracket to the sink deck such said shank is spaced from the sink deck.

5. The mounting assembly of claim 1, wherein said internal walls of said spout insulator further comprise a top tube aperture in adjacent open relation with said top shank aperture such that at least a portion of said top tube aperture and said top shank aperture are in open engagement, said mounting bracket further comprising internal walls defining a bottom tube aperture in adjacent closed relation with said bottom shank aperture such that said bottom tube aperture and said bottom shank aperture are separated by said boss, said top tube aperture configured to be aligned with said bottom tube aperture when said respective spout insulator and said mounting bracket are attached to the sink deck, said aligned top tube and bottom tube apertures configured to receive water supply tubes.

6. The mounting assembly of claim 1, wherein said sink deck is formed of a metal.

7. The mounting assembly of claim 1, wherein said spout insulator is formed of a polymeric material.

8. The mounting assembly of claim 1, wherein said mounting bracket is formed of a polymeric material.

9. The mounting assembly of claim 8, wherein said mounting bracket is formed of a thermoplastic.

10. The mounting assembly of claim 1, wherein the projecting lip is sufficient in height to project above a top surface of the sink deck when said mounting bracket is attached to the bottom surface of the sink deck.

11. The mounting assembly of claim 1, wherein said mounting bracket further comprises a pair of horizontally projecting wire clips spaced from said underside of said sink when said mounting bracket is attached to the bottom surface of the sink deck, said wire clips being configured to receive one or more wires.

12. A mounting assembly for use with an electronic faucet to attach the faucet to a sink deck having a bottom surface and a sink deck aperture, the mounting assembly comprising:

an electrically non-conductive mounting bracket configured to attach to the bottom surface of the sink deck, said mounting bracket including a boss defining a bottom shank aperture, said boss including a projecting lip, said projecting lip sufficient in height to extend into the sink deck aperture and project above a bottom surface of the sink deck when said mounting bracket is attached to the bottom surface of the sink deck; and an electrically conductive shank extending downwardly from above the sink deck, through the sink deck aperture and said bottom shank aperture of said mounting bracket;

wherein said mounting bracket further comprises internal walls defining a bottom tube aperture in adjacent closed relation with said bottom shank aperture such that said bottom tube aperture and said bottom shank aperture are separated by said boss, said bottom tube aperture configured to receive water supply tubes.

13. The mounting assembly of claim 12, further comprising a fastening device sized for receipt on said shank, said fastening device configured to attach said mounting bracket to the sink deck such that, upon attachment, said shank is spaced from the sink deck.

14. The mounting assembly of claim 12, wherein said mounting bracket comprises a polymeric material.

15. The mounting assembly of claim 14, wherein said mounting bracket is plastic.

16. The mounting assembly of claim 12, wherein said mounting bracket further comprises a pair of horizontally projecting wire clips spaced from said underside of said sink, said wire clips are configured to receive one or more wires.

17. A method for attaching a mounting assembly to a sink deck, the method comprising the steps of:

attaching a delivery spout including a metal shank to a spout insulator having a top shank aperture;

extending the shank through the top shank aperture of the spout insulator;

disposing the spout insulator over a sink deck aperture;

disposing a mounting bracket under the sink deck aperture such that a projecting lip of a boss of the mounting bracket extends upwardly into the sink deck aperture and is spaced from the spout insulator;

extending the shank through the boss of the mounting bracket; and fastening the mounting bracket and the spout insulator to the sink deck wherein said fastening includes coupling a nut about the shank to secure the mounting bracket to the sink deck by threadably engaging the shank until the nut abuts and is tightened against the mounting bracket to secure the mounting bracket to the sink deck, such tightening allowing for the spout insulator to be firmly secured to an opposite side of the sink deck, whereby the shank is spaced from the sink deck.

18. The method of claim 17, wherein said disposing a mounting bracket under the sink deck aperture comprises the projecting lip of the boss of the mounting bracket being spaced from internal walls of the spout insulator via a radial clearance.

19. The method of claim 17, wherein said disposing a mounting bracket under the sink deck aperture comprises the projecting lip of the boss of the mounting bracket being horizontally spaced from internal walls of the spout insulator via a horizontal radial clearance, said bottom aperture of said spout insulator being disposed below and in open communication with said top shank aperture of said spout insulator.

20. A mounting assembly for attaching a delivery spout to a sink deck having an aperture therethrough, the assembly comprising:

a spout insulator having a top shank aperture;

a mounting bracket configured to be positioned under the sink deck aperture such that a projecting lip of a boss of the mounting bracket extends upwardly into the sink deck aperture and is spaced from the spout insulator;

the delivery spout including a metal shank configured to extend through the top shank aperture of the spout insulator, the sink deck aperture, and the boss of the mounting bracket, and;

a nut configured to threadably engage and couple about the metal shank to secure the mounting bracket and spout insulator to the sink deck such that the shank is spaced from the sink deck.

* * * * *